US006846151B2

(12) United States Patent
Mayerberg, II et al.

(10) Patent No.: US 6,846,151 B2
(45) Date of Patent: Jan. 25, 2005

(54) NON-CONTACT AERODYNAMIC DIVERTER/STACKER INSERTION SYSTEM

(75) Inventors: Willson L. Mayerberg, II, Skiatook, OK (US); Randall E. White, Owego, NY (US)

(73) Assignee: Lockhead Martin Corporation, Bethesda, MD (US)

( * ) Notice: Subject to any disclaimer, the term of this patent is extended or adjusted under 35 U.S.C. 154(b) by 1 day.

(21) Appl. No.: 10/369,589

(22) Filed: Feb. 21, 2003

(65) Prior Publication Data

US 2004/0164480 A1 Aug. 26, 2004

(51) Int. Cl.[7] ..... B65G 35/00
(52) U.S. Cl. ..... 414/676; 271/211
(58) Field of Search ..... 414/676, 903; 271/211

(56) References Cited

U.S. PATENT DOCUMENTS

| | | | | |
|---|---|---|---|---|
| 2,052,869 A | | 9/1936 | Coanda | |
| 3,498,599 A | * | 3/1970 | Smith | 271/211 |
| 4,056,264 A | * | 11/1977 | Dhooge et al. | 271/177 |
| 4,575,042 A | | 3/1986 | Grimland et al. | |
| 5,324,024 A | * | 6/1994 | Mori | 271/296 |
| 5,339,964 A | | 8/1994 | Gray et al. | |
| 5,451,125 A | | 9/1995 | Lenhart | |
| 5,738,467 A | | 4/1998 | Aidlin et al. | |
| 5,810,516 A | | 9/1998 | Ouellette | |
| 5,941,520 A | | 8/1999 | Stephan et al. | |
| 6,042,307 A | | 3/2000 | Lenhart | |

* cited by examiner

*Primary Examiner*—Joe Dillon, Jr.
(74) *Attorney, Agent, or Firm*—Whitham, Curtis & Christofferson, P.C.

(57) ABSTRACT

Objects such as pieces of mail are stacked without making significant mechanical contact with the objects by an apparatus producing a laminar flow of air over a surface which defines or parallels the desired path of movement for the objects. The objects are placed to form a barrier between the laminar air flow and ambient air so that movement, such as turning an edge of the object to prevent impact on other objects and regulation of direction velocity and kinetic energy of the motion of the objects, may be guided by the Coanda effect of the laminar flow of air. The placement of the objects thus provides an acoustic barrier to reduce the generation and propagation of noise by the high pressure air used to create the laminar flow of air. An air amplifier reduces the volume of high pressure air required to control the movement of the objects.

10 Claims, 4 Drawing Sheets

NON-CONTACT AERODYNAMIC DIVERTER/STACKER INSERTION SYSTEM

BACKGROUND OF THE INVENTION

1. Field of the Invention

The present invention generally relates to object transport and sorting systems and, more particularly, to object placement and stacking structures at destination pockets of such systems.

2. Description of the Prior Art

The transport of material and objects is an important feature of many industrial activities, particularly when material or objects must be moved on a large scale. Many such systems include arrangements for sorting of objects or material in accordance with properties thereof or indicia placed on the objects. For example, large volumes of mail or packages which must be transported to different locations must first be sorted in accordance with addresses placed thereon in the course of being transported to different locations in a sorting facility. Similar systems and applications may be encountered in baggage handling in airports and the like.

Such sorting of objects requires the objects to be handled in sequence in order to provide selectivity of handling and direction to various locations from which groups of objects that can be commonly transported to another location. This requirement generally implies that the objects must be transported at relatively high speed in order to accommodate the volume of objects which are presented. While it is possible to regulate the speed of objects somewhat in a high volume sorting apparatus, it is not generally possible to provide space to allow significant deceleration of objects as they approach their final destination in the sorting machinery. Therefore, as the object approaches a final destination such as a sorting bin or a stacker apparatus (sometimes referred to as a destination pocket or, simply, pocket) in the sorting system, the deceleration must usually be quite abrupt and often involves allowing the object to impact more or less violently on a surface or barrier such as the side of a destination pocket in a largely uncontrolled motion possibly including substantial rebound and, at least, not allowing the deposited articles to be placed in the destination pocket in an orderly fashion such as a stack.

Orderly positioning of objects in a destination pocket, often referred to as "neatness", "raggedness" (e.g. "left-edge raggedness") or, more generally, "stack quality", is essential to avoid jamming of the system and damage to the objects following collisions between the trailing edge of an object and the leading edge of another object sent to the same bin, often in very rapid succession (e.g. as much as fifteen objects per second). Less than optimal stack quality and objects that assume a tilted orientation, in particular, present edges and surfaces and otherwise occupy a portion of the volume of the pocket where collisions are likely. Further, since these variations from an ideal stack are essentially random, they are not readily resolved by machinery once they occur.

For example, to improve the orderly placement of objects in a destination pocket, several additional types of device have been employed: one being of an auger type and another being a pneumatically actuated pusher. An exemplary mechanism including both of these known devices is shown in FIG. 5. (The depiction of FIG. 5 is arranged to illustrate operation of the known devices in a manner to facilitate comparison with the present invention and no portion of FIG. 5 is admitted to be prior art in regard thereto. Therefore, FIG. 5 has been designated as "Related Art".) An incoming article or piece of mail is directed along plate 510 and one edge of the article is engaged by auger 520 which seeks to turn the article along the angled portion of plate 510. Once the article is turned, it may be pushed into place in a stack by pusher plate 530, actuated by pneumatic actuator 540. Sorting of mail pieces is accomplished by gates 550 which direct articles to one side or the other of roller 560 as they are passed along a path defined by rollers 570. It should also be appreciated that FIG. 5 illustrates a portion of the sorting mechanism which forms a part of the immediately downstream sorting mechanism and pocket.

Unfortunately, it has been found that collisions remain likely to occur between the leading edge of an object and some structure of the auger 520 or pusher 530, 540 as it manipulates objects previously placed in the pocket while continuing to allow rebound of a substantial number of objects which reduces the effectiveness of the additional structures and continues to be a source of collisions and jamming.

It has also been found that some widely used types of mail envelopes, particularly a back-side vertically oriented, end-flap-sealed C-5 envelope referred to as "Australia Post" which is of very light weight and flexible has proven very difficult to handle and is a major source of collisions, damage and jamming in mail sorting system including systems equipped with one of the additional auger or pusher device described above. In particular, as one envelope of the Australia Post type or an edge thereof is slid across another, an edge of one envelope will often engage an incompletely sealed portion of the sealing flap of another, preventing registration of envelopes in a stack or with the sides of the destination pocket. Further, it has been found, particularly in regard to the Australia Post envelope, that such auger and/or pusher devices are a source of article or object damage as well as a source of noise and particulates (e.g. cellulose paper dust) and a potential source of injury to personnel.

Since objects such as mail envelopes are often essentially "flown" into a destination pocket, and the importance of the aerodynamics of the objects has been recognized and, occasionally, exploited, it has been proposed to direct movement of objects with air currents. However, operational costs can become prohibitive when even moderate amounts of pressurized air at effective velocities are required. It is generally considered that the number of destination pockets required on many mail sorters would multiply such air requirements beyond the realm of feasibility even if relatively efficient arrangements could be designed. Further, any such arrangement must accommodate both incoming objects and objects previously deposited and exert control over such objects reliably over multiple degrees of freedom while the orientation and motion of the objects may vary widely to both establish and maintain good stack quality. In other words, the amount and number of features of control may be very limited consistent with other types of control which may be desired. Other factors which also present problems in the use of pressurized air are the generation of white noise and the generation of particulates which may affect the operation of the apparatus and possibly engender the potential for occupational hazards.

SUMMARY OF THE INVENTION

Accordingly, the present invention provides an improved arrangement for establishing and maintaining orderly placement of objects in a destination pocket. The invention also provides for improved, reliable and repeatable handling of particularly light-weight and flexible objects such as the Australia Post envelope with reduced noise, generation of particulates and injury hazard, both to objects and operators. Further, the invention provides consistent and reliable handling and stacking of object by air flow while reducing the volume of high pressure and/or high velocity air that is required.

In order to achieve these and other effects of the invention, a stacker apparatus is provided comprising a plate having a curved portion, nozzle or the like for producing a laminar flow of air over the curved portion of the surface and directed along a path of desired object movement, and an arrangement for directing an object along the laminar flow of air whereby motion of said object is regulated along the path of movement by the laminar air flow.

In accordance with another aspect of the invention, a method of controlling movement of an object is provided comprising steps of directing a laminar flow of air along a surface to define a path of movement, placing an object adjacent the laminar flow of air, and regulating motion of said object along said path of movement using said laminar flow of air.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
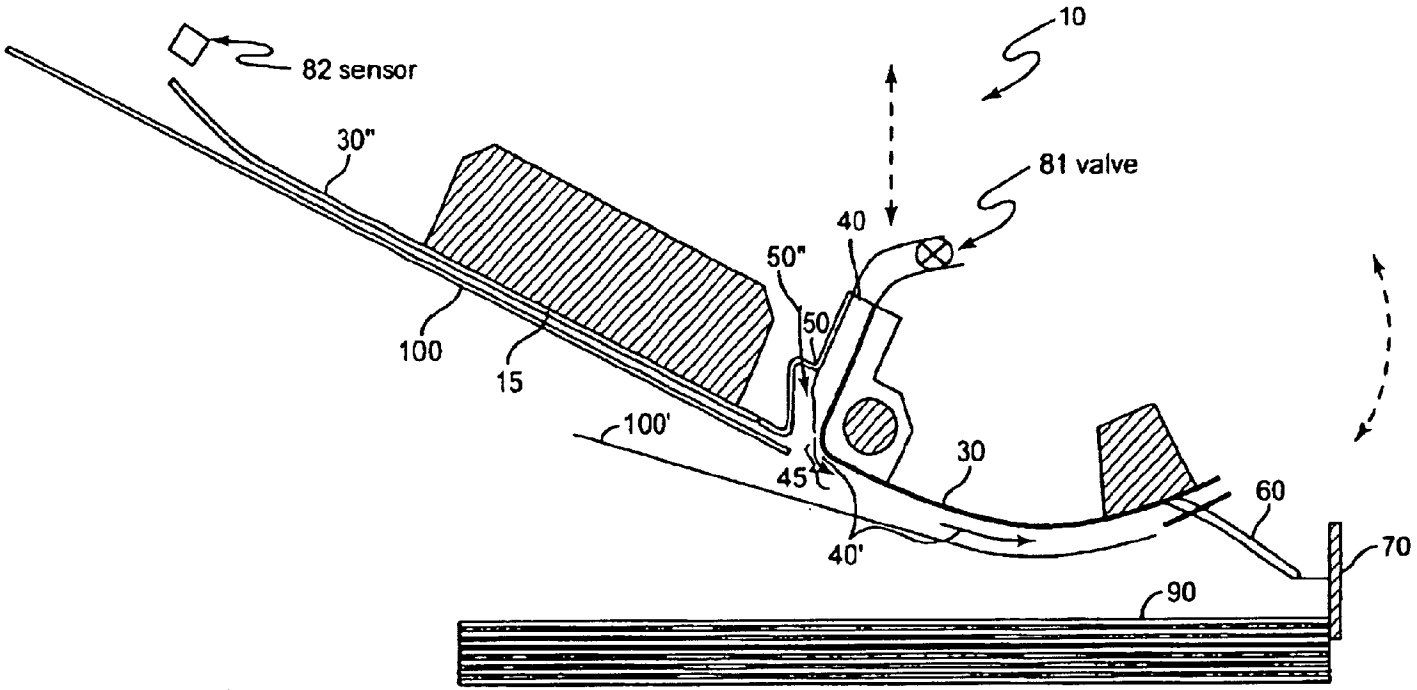
FIG. 1 is a top view of a stacker destination pocket in accordance with the invention installed therein.
Figure 2:
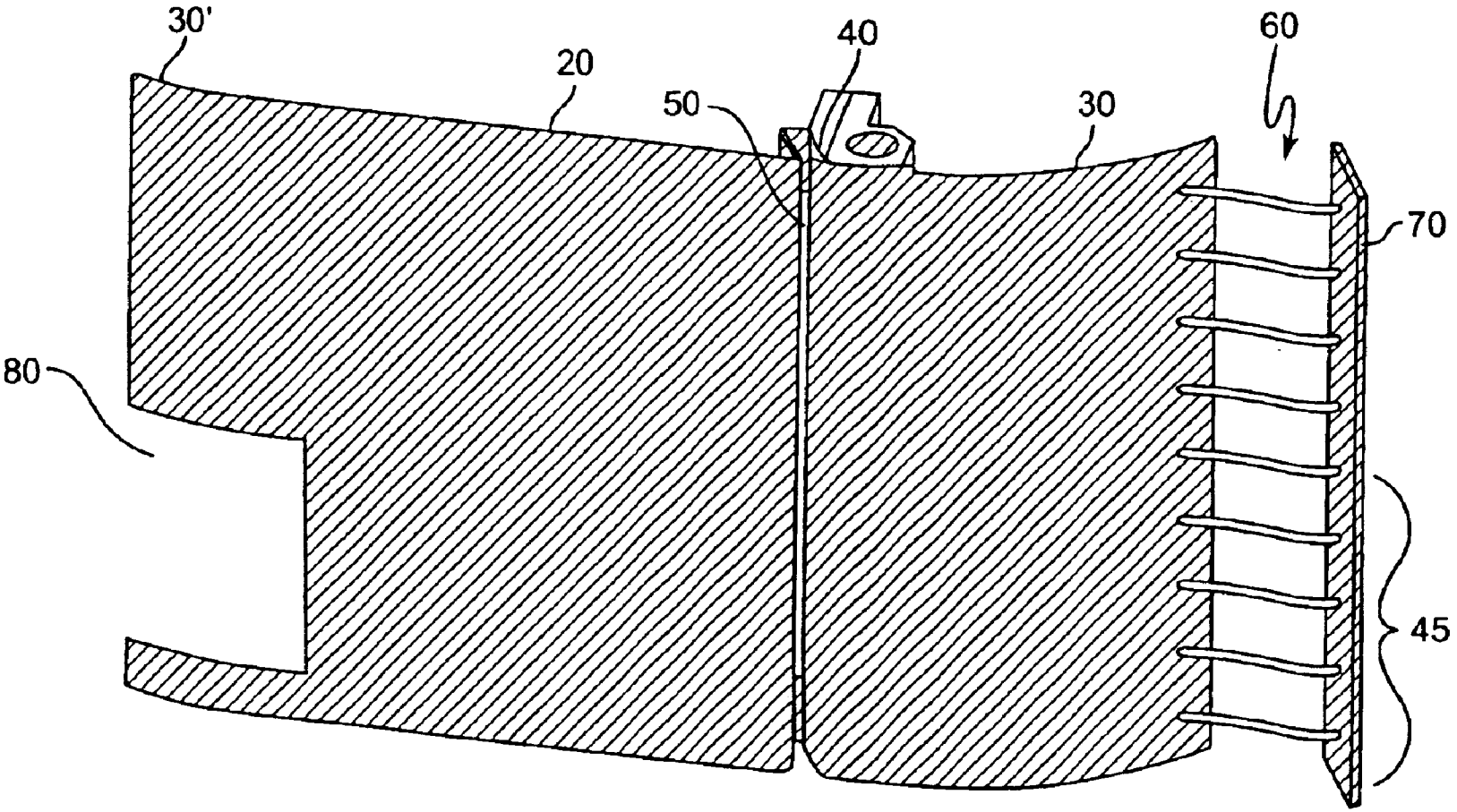
FIG. 2 is an oblique front view of the stacker in accordance with the invention, FIG. 3 schematically depicts an interaction of objects which the invention principally seeks to avoid.

Referring now to the drawings, and more particularly to FIGS. 1 and 2, there is shown a top view of a destination pocket with the stacker in accordance with the invention installed therein and a front oblique view of the stacker, respectively. The same reference numerals will be used to indicate corresponding features in both views.

The stacker 10 in accordance with the invention has no moving parts and is generally placed in a fixed location in a destination pocket in line with incoming mail pieces. However, it is possible and may be desirable in some cases to provide some degree of motion such as change of height above the bottom of the destination pocket and/or rotation (in the directions indicated by dashed arrows) in order to accommodate larger stacks of objects or to maintain the object handling characteristics of the invention as stack height increases.

The stacker 10 comprises a plate 20 with slightly curved ends 30, 30'. The plate 20 can be formed easily and inexpensively from any of a number of materials such as sheet metal or polymers. The plate 20 is preferably substantially rigid but some flexibility may be useful in absorbing some energy of incoming objects. However, the position of the plate 20 should be well-controlled and oscillation such as ringing from impact of objects should generally be avoided. The curvature of end 30' is not at all critical to the practice of the invention and need only accommodate some variation of position of incoming objects 100 so that the objects do not strike the edge of plate 20 but pass smoothly along it. In general, objects will tend to move closely along the surface of plate 20 and contact will generally be slight if at all since the air flow between the object and the flat stationary plate will cause a slight lowering of pressure by Bernoulli effect therebetween. Thus the motion of an incoming object is generally well-controlled while the object is relatively remote from stack 90.

However, if an object continues along this path defined by the flat portion of plate 20 (and possibly rollers; an exemplary clearance cut-out for which is depicted at 80), the edge of an incoming object will impact at some point on the surface of a previously stacked object at substantial speed. The friction resulting from this action will generate particulate matter from the surfaces of the objects. This particulate matter may accumulate to cause malfunctioning of the sorter system or other apparatus in the vicinity and/or reduce the environmental quality for personnel operating the sorter system. Further, little energy will be dissipated and the incoming object is likely to rebound from the end of the destination pocket in a largely uncontrolled motion; causing collisions with further incoming objects or at least causing the stacking to be irregular.

Figure 3:
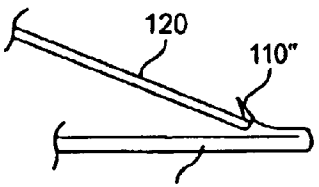

A particularly intractable problem prior to the present invention is illustrated in FIG. 3. If an object 110 placed on the stack has some irregularity 110' such as an incompletely sealed flap, as is presented by the "Australia Post" envelope 110 alluded to above, or even an incompletely adhered stamp or the like on the upper side of the object 110, as stacked, the impact of the edge of an incoming object 120 can force the edge thereof under the irregularity and cause damage thereto. More importantly in regard to the stacking operation, the arresting of the incoming object 120 by the irregularity 110' prevents the proper placement of the object 120 on the stack and actually tends to impede movement of the object 120 from a position such that collisions are more likely to occur. That is, when objects 110 and 120 are held together, as shown, however tenuously, object 120 can settle onto object 110 only as air flows out from between them. Therefore, the trailing edge of object 120 will remain close to the path of further incoming objects for a longer time than would otherwise be the case.

It should be appreciated that in order to avoid the scenario depicted in FIG. 3, the leading edge of an incoming object 100 must be turned slightly as it approaches the stack 90. A substantially ideal action, achieved by the invention in a manner which will be discussed in detail below is depicted in FIG. 1 at 100'. More specifically, turning of the leading edge not only avoids direct impact of an object 100 with stack 90 but also causes an overall rotation of the object which tends to more quickly move the trailing edge of the object from the path of a following incoming object. Moreover, turning of the leading edge of the object allows it to be directed to an arresting arrangement which can reduce or avoid rebounding action and/or generation of particulates. Further, in accordance with the invention, additional guidance may be provided to the object 100 which will also assist in achieving and maintaining the quality of stack 90.

The invention achieves these effects in a manner which avoids mechanical contact with the object by utilizing pressurized air while limiting the amount of pressurized air which is required to do so. It can be appreciated from the top view of the invention of FIG. 1 that these two criteria cannot be satisfied by application of air to the trailing edge of incoming objects 100 since the air would necessarily be applied from a location at a distance greater than the stack length (e.g. left to right in FIG. 1) away from the location at which the turning of the object edge would be achieved. At the same time, providing pressurized air between stack 90 and incoming object 100 would tend to impede movement of object 100 out of the path of further incoming objects 100 and increase the likelihood of collisions, object damage, poor stack quality and jamming of the sorter. In summary, a large volume of air would be required at high pressure and high velocity to achieve turning of the edge of an incoming objects and which may be ineffective to achieve edge turning with sufficient rapidity while other problems of stacking would be exacerbated.

The invention achieves extremely quick edge turning with a small volume of air by introducing air between the object and plate 20 which also has additional advantageous effects as will be described in detail below. Specifically, in accordance with a preferred embodiment of the invention, plate 20 is divided along its height prior (along the incoming object path) to the curvature of an end portion 30 thereof. At this location, a curved region 45 is formed and a nozzle in the form of a very narrow elongated slot 40 (sometimes referred to as an air knife) is placed adjacent thereto and preferably including an inclined edge or surface to direct air thereover in close proximity to the curved region 45.

Thus a substantially laminar air flow regime is established at curved region 45 and, further across and along curved portion 30. A slot 50 is also provided at the other side of the air knife 40 and the reduced pressure of air moving across region 45 causes air to be drawn into slot 50, as indicated by arrow 50'. This entrained air 50' greatly augments the volume of air flowing across the curved portion 30 of plate 20 and the combination of an air knife 40 and slot 50 thus functions as an air amplifier; greatly reducing the amount of high pressure air required (which is preferably further reduced by valves 82 controlled by sensors 81 at the infeed end of plate 20 and/or the diverter control signals of the sorter system). This augmented air flow follows the curved surface 30 of plate 20 and carries and guides the object 100 by the Coanda effect until the air is allowed to exit at a grill 60 which is preferably inclined to the air flow and object motion and preferably arranged to support an object arresting surface such as a mail stop 70 that defines an end of stack 90. The volume and velocity of air from the air knife and from the air amplifier are not critical and suitable values may be readily determined theoretically or empirically in accordance with the range of weight and dimensions of articles or objects to be stacked.

The location of the sensors or the timing of air control in accordance with the diverter control signals of the sorter system is preferably arranged such that the air knife acts only on the leading edge of the article or object to achieve a turning effect. The trailing edges thus "kicks out" from plate 20 to a greater or lesser degree depending on the weight and stiffness of the article.

The angled orientation of the grill 60 serves to deflect the edge of incoming objects downward while absorbing energy therefrom without causing damage or generation of any significant amount of particulates. At the same time, the location of the grill directs the air being exhausted from the stacker to carry and guide the object toward the mail stop 70 to form a high quality stack 90. The curved surface 30 thus controls the formation of vortices and provides extremely laminar flow defining a well-behaved and adaptive pneumatic envelope and movement path for the objects with well-controlled pressure gradients formed and directed in a highly predictable and repeatable manner to facilitate the direction, velocity and inertial energy of incoming objects.

In this latter regard, it should be appreciated that the incoming objects are substantially enclosed in the air flow between the ambient air pressure and the reduced pressure along the curved surface 30 where the air flow is accelerated. That is, the object separates these two regions of different air flow and is essentially held in place between them while the air flow along the curved surface 30 establishes a movement path and, effectively, "lubricates" the stacker surfaces adjacent to the objects; largely avoiding contact between them and dramatically reducing production of particulates. The effects, while somewhat similar to those produced by shear forces and object motion upstream of the air amplifier along plate 20, described above, will be dramatically increased downstream of the air amplifier where the air flow is accelerated. By the same token, forces which will be applied to the incoming objects at various locations along the movement path will conform the object motion to the air flow and the movement path defined thereby. Thus the stacker in accordance with the invention automatically adapts the handling forces applied to each object in accordance with the direction, speed and inertia of the object. That is, heavier objects having more inertia will be decelerated and kinetic energy removed and dissipated while lighter objects are effectively carried to the desired location on the stack 90.

This arrangement also limits production of white noise by the reduction of the required volume of high pressure air. Propagation of the relatively low level of noise produced is also limited by the physical arrangement in accordance with the invention. Noise production as well as high pressure air volume requirements can also be further reduced, as a perfecting feature of the invention, by dividing the air knife structure along its width as indicated by bracket 45 at one or more locations and using only the portion of the air knife as may generally correspond to the height of an object as may be determined by appropriate sensors or other expedients which will be apparent to those skilled in the art. The use of a sensor and/or control signals from the sorter, as alluded to above, also assures not only that the high pressure air will be applied "on demand" to reduce the volume of high pressure air required but also develops the above-described flow regimes only when an object is adjacent the air knife or appropriate portion thereof. The object thus forms an acoustic barrier which contains the air amplifier behind it and essentially forms a sonic control conduit along the object transport path.

Noise does not significantly propagate from slot 50 since the air flow is in the opposite direction at substantial volume. Residual noise is reflected from the object vertically and horizontally away from the operator by the vents in grill 60. Since the stacker in accordance with the invention has no moving parts, there is no contribution of mechanical noise other than the irreducible noise from the stacking of the objects themselves. Thus the sonic pressure and audible noise can be maintained well below industry limits.

In view of the foregoing, it is seen that the invention provides the advantageous effects of adaptive control over delivery and stacking of objects that can vary significantly in dimensions, shape and weight while limiting contact with the objects while greatly reducing high pressure air requirements and generation and propagation of noise as well as generation of particulates. The air flow and resulting vacuum is regulated upstream of the air amplifier by the shear forces on the ambient air due to object movement and the stationary plate 20 and much increased downstream along the curved portion 30 to turn the object edges and regulate the direction velocity and kinetic energy of objects in an adaptive manner downstream of the air amplifier due to the Coanda effect to achieve high quality stacking of the objects. The apparatus can be easily and inexpensively fabricated and can be retrofit into virtually any sorting or material handling structure where a stacking function is desired.

Figure 4:
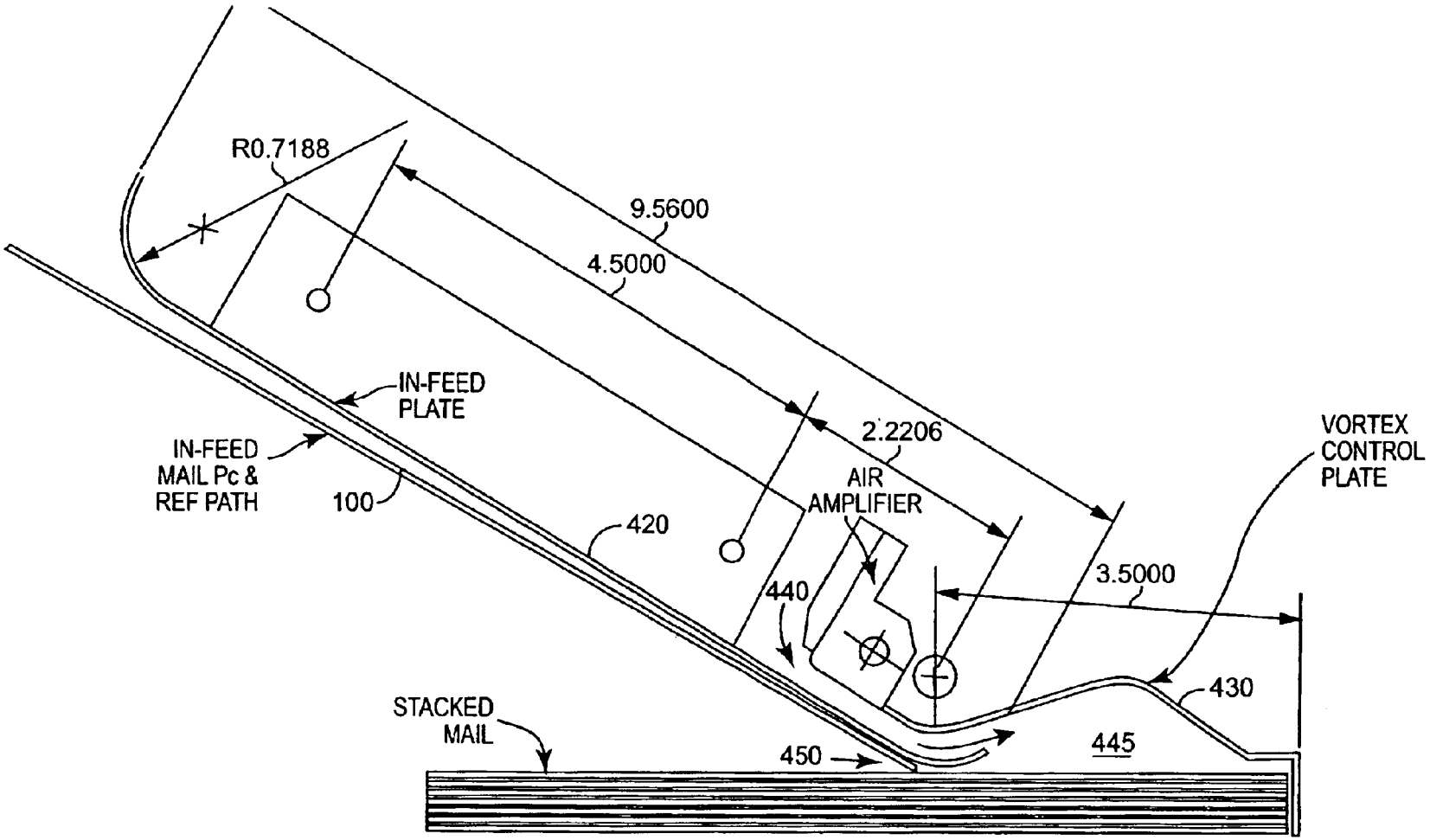
FIG. 4 is a top view of an alternative, variant form of the stacker in accordance with the invention.
Figure 5:
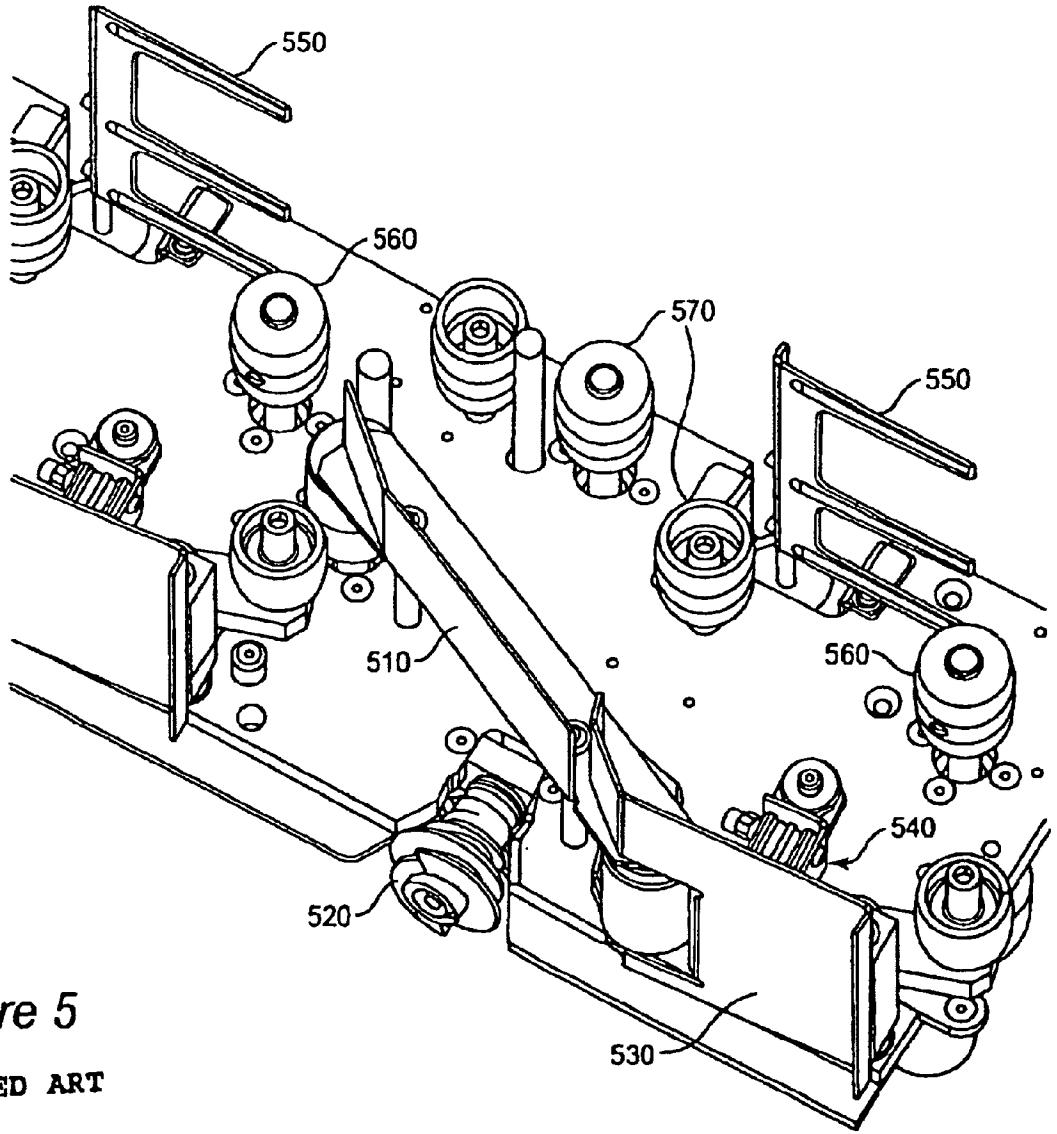
Figure 5 RELATED ART
FIG. 5 is a top view of a related mechanism over which the present invention provides significant improvements.

It should be understood that the Coanda effect can be applied to objects in other ways in variations of the invention such as that shown in FIG. 4. In this embodiment of the invention, objects are directed along in-feed plate 420 in much the same manner as described above upstream of the air amplifier but are allowed to impact on the stack. The air amplifier is formed by the high pressure air flow 440 and the gap between the end of the in-feed plate 420 and the stack. thus the Coanda effect is developed in region 445 and the objects pulled into placed on the stack thereby curved surface 430 is preferably formed to have a plurality of finger-shaped portions and provides for convenience of fabrication since features functioning as the air vent and the mail stop structures of FIG. 1 can be integrally formed therewith. However, since the objects are allowed to directly impact on the stack, this embodiment is not preferred although most of the effects of the invention except reduction of particulate production can be achieved.

While the invention has been described in terms of a single preferred embodiment, those skilled in the art will recognize that the invention can be practiced with modification within the spirit and scope of the appended claims. For example, while the invention has been described in connection with a preferred vertical orientation of generally flat objects and articles, it is clear that the principles of the invention are applicable to operation in other orientations and/or objects of other shapes.

What is claimed is:

1. A stacker apparatus comprising a plate having a curved portion, means for producing a laminar flow of air across said curved portion of said plate and directing said laminar flow of air along a path of desired object movement, such that an object may follow along said laminar flow of air and guided along said path of movement by said laminar flow of air to a receptacle where objects may be collected or stacked.

2. A stacker as recited in claim 1, wherein said means for producing a laminar flow of air includes an air knife.

3. A stacker as recited in claim 1, wherein said means for producing a laminar flow of air includes an air amplifier.

4. A stacker as recited in claim 2, wherein said means for producing a laminar flow of air includes an air amplifier.

5. A stacker as recited in claim 1, further including a valve for controlling said means for producing a laminar flow of air.

6. A stacker as recited in claim 5, wherein said valve is controlled responsive to a sensor.

7. A stacker as recited in claim 1, wherein said means for producing a laminar flow of air is divided into sections across the width of an object path.

8. A stacker as recited in claim 7, wherein respective one of said sections of said means for producing a laminar flow of air are selectively controlled.

9. A stacker as recited in claim 8, further including means for sensing dimensions of an article to perform said selective control of said respective sections.

10. A stacker as recited in claim 9, further including a sensor for controlling said means for producing said laminar flow in accordance with detection of a said object.

* * * * *

UNITED STATES PATENT AND TRADEMARK OFFICE

CERTIFICATE OF CORRECTION

PATENT NO. : 6,846,151 B2
DATED : January 25, 2005
INVENTOR(S) : Mayerberg, II et al.

It is certified that error appears in the above-identified patent and that said Letters Patent is hereby corrected as shown below:

Title page,
Item [73], Assignee, should read -- Lockheed Martin Corporation --

Signed and Sealed this

Nineteenth Day of April, 2005

JON W. DUDAS
*Director of the United States Patent and Trademark Office*